US005428261A

United States Patent [19]

Wittig et al.

[11] Patent Number: 5,428,261

[45] Date of Patent: Jun. 27, 1995

[54] SINGLE-ENDED, PLASTIC-BASED HIGH-PRESSURE DISCHARGE LAMP

[75] Inventors: Christian Wittig, Munich; Manfred Gaugel, Fuerstenfeldbruck, both of Germany

[73] Assignee: Patent-Treuhand-Gesellschaft F. Elektrische Gluehlampen mbH, Munich, Germany

[21] Appl. No.: 78,430

[22] Filed: Jun. 16, 1993

[30] Foreign Application Priority Data

Jul. 17, 1992 [DE] Germany ..... 42 23 643.6

[51] Int. Cl.[6] ..... H01J 5/48

[52] U.S. Cl. ..... 313/318.1; 313/49; 439/611

[58] Field of Search ..... 313/49, 51, 38; 439/611, 612, 617, 485

[56] References Cited

U.S. PATENT DOCUMENTS

| | | | |
|---|---|---|---|
| 4,533,851 | 8/1985 | Block et al. | 439/612 |
| 4,626,734 | 12/1986 | Greiler | 313/318 |
| 4,795,939 | 1/1989 | Eckhardt et al. | 313/318 |
| 5,021,706 | 6/1991 | Chen | 313/318 |
| 5,036,439 | 7/1991 | Hoffmann et al. | 313/318 |
| 5,039,904 | 8/1991 | Kosmatka et al. | 313/318 |
| 5,172,026 | 12/1992 | Hall et al. | 313/318 |
| 5,216,318 | 6/1993 | Van Dulmen et al. | 313/318 |
| 5,216,319 | 6/1993 | Van Heeswijk | 313/318 |
| 5,220,235 | 6/1993 | Wakimizu et al. | 313/318 |
| 5,291,092 | 3/1994 | Coushaine | 313/318 |

FOREIGN PATENT DOCUMENTS

| | | |
|---|---|---|
| 0231936A2 | 8/1987 | European Pat. Off. . |
| 0367343A2 | 5/1990 | European Pat. Off. . |
| 0478058A1 | 4/1992 | European Pat. Off. . |
| 0493844A1 | 7/1992 | European Pat. Off. . |

*Primary Examiner*—Sandra L. O'Shea
*Assistant Examiner*—Vip Patel
*Attorney, Agent, or Firm*—Frishauf, Holtz, Goodman & Woodward

[57] ABSTRACT

To protect the plastic material of a plastic base (2) holding a single-ended high pressure discharge vessel (1) in position with respect to ultraviolet (UV) radiation and heat emitted from the discharge vessel in operation of the lamp, a cover element (7, 7') of UV radiation and high temperature resistant material, such as a ceramic and preferably aluminum oxide, is positioned between the discharge vessel and the plastic material of the base, located to shield the plastic base from UV and heat radiation. The cover element is, essentially, in disk or plate form, and irremovably connected to the base, for example by pin extensions integral with the base, passing through recessed openings in the cover element, and headed over, in the form of rivet or button heads, for example by ultrasonic welding.

16 Claims, 5 Drawing Sheets

SINGLE-ENDED, PLASTIC-BASED HIGH-PRESSURE DISCHARGE LAMP

Reference to related patent, assigned to the assignee of the present application: U.S. Pat. No. 4,795,939, Eckhardt et al. Reference to related application, assigned to the assignee of the present application, the disclosure of which is hereby incorporated by reference: U.S. Ser. No. 07/694,465, filed May 1, 1991, Schoenherr et al, (attorney docket 901081-shf; GR 90P5522 US).

FIELD OF THE INVENTION

The present invention relates to a single-ended high-pressure discharge lamp having a plastic base, and in which the material of the base is protected against damaging radiation emitted by the high-pressure lamp in operation thereof, especially ultraviolet (UV) radiation and heat radiation.

BACKGROUND

A lamp of the general type to which the present invention relates is shown and described in the referenced application Ser. No. 07/694,465, filed May 1, 1991, Schoenherr et al, assigned to the assignee of the present application. The lamp is a single-based high-pressure discharge lamp, particularly suitable for use in automotive headlights. The discharge vessel of the lamp is formed with an essentially cylindrical extension, which may be hollow, that is, tubular. The extension is melt-seated in the base by using a high-frequency responsive material within the plastic material. Upon application of an electrical high-frequency field, the plastic material surrounding the extension will melt and securely retain the discharge vessel in position in the plastic base. An adhesive and melt connection will thus be formed between the glass of the vessel and the plastic of the base.

It has been found that, in extended operation of the lamp, the base may deteriorate. As the plastic material ages, it has a tendency to shrink and lose material by vaporization. This change in the plastic base may interfere with reliable retention of the discharge vessel in the base. Since the discharge vessel must be accurately aligned within the base, so that, when the base is fitted into an optical system, for example a reflector, the discharge will take place at a defined position with respect to the optical system, it is important that the accurately positioned location of the lamp with respect to the base be retained over the entire operating lifetime of the discharge vessel itself. The danger arises that material from the base which vaporizes may deposit on the optical system, for example on the surface of a reflector, to form precipitates thereon, leading to premature loss of light and dulling of the reflector surface.

THE INVENTION

It is an object to improve discharge vessels with plastic bases so that the integrity of the discharge vessel-base combination is ensured over a long lifetime, in spite of emission of UV radiation and heat radiation from the discharge vessel.

Briefly, a shielding arrangement is provided to separate the discharge vessel itself from the plastic base. This shielding arrangement includes, in accordance with a feature of the invention, a cover element of high-temperature resistant and UV radiation resistant material, typically a ceramic disk or the like, and, for example, made of aluminum oxide. The cover is positioned to shield the plastic base from UV and heat radiation emitted from the discharge vessel when the lamp is in use. It is not necessary that the cover is made of ceramic, or, for example, of aluminum oxide. Other materials, resistant with respect to UV radiation and high temperatures, may be used. Ceramics are preferred due to the low heat transmissivity of the material and, additionally, the excellent characteristics with respect to electrical insulation.

The present invention is based on investigations of the effect of radiation emitted by the lamp, which reaches the base. The particular radiation which was found to deleteriously affect the base is the UV radiation as well as the heat radiation, and resulting thermal loading of the material of the base.

Preferably, the base includes a holding portion used to reliably position the discharge vessel therein. In addition, the base, preferably, has a connecting portion which, selectively, may be of different configuration. The connecting portion is formed with electrical terminals which can be constructed to meet various sockets, in accordance with design requirements. The coupling of the selectively different connecting portions to the holding portion is, preferably, by a snap-in connection which cannot be released without breaking the connection or coupling so that, in effect, the two portions are irremovably interconnected. This arrangement, in accordance with a feature of the invention, permits manufacture of a single base holding portion which then can be coupled to different connecting portions having different electrical terminal arrangements, thus providing a highly versatile discharge vessel-base combination.

The cover which separates the discharge vessel from the plastic base itself is exposed in operation of the lamp to the UV radiation emitted by the discharge vessel, as well as to the high temperatures which result during operation. The cover, opaque to UV radiation, thus shields the holding portion of the base from the UV radiation emitted by the discharge vessel as well as from the high temperatures and thus prevents damage of the plastic material of the base by excessive thermal loading, as well as by the effects of UV radiation.

The discharge vessel, in accordance with a feature of the invention, includes an elongated end portion which, typically, is cylindrical or tubular, so that, preferably without use of cements, it can be seated in the holding portion of the base either by a metallic clamp or clip or, as described in the referenced application, by a melt seal in connection with high frequency induced heating of the base material. Holding the lamp without cement has the additional advantage that the lifetime of the lamp is extended since cement, under the temperature conditions still prevailing within the base, may tend to emit vapors and, in an extreme case, fail.

Preferably, the connecting portion of the base is formed with separating fins or projections to separate the voltage carrying portions and leads extending from the lamp to the electrical connection, to provide an interposed labyrinthene path and thus increase the resistance against high voltage arc-over within the base and extend any possible creep paths.

DRAWINGS

DETAILED DESCRIPTION

Figure 1:
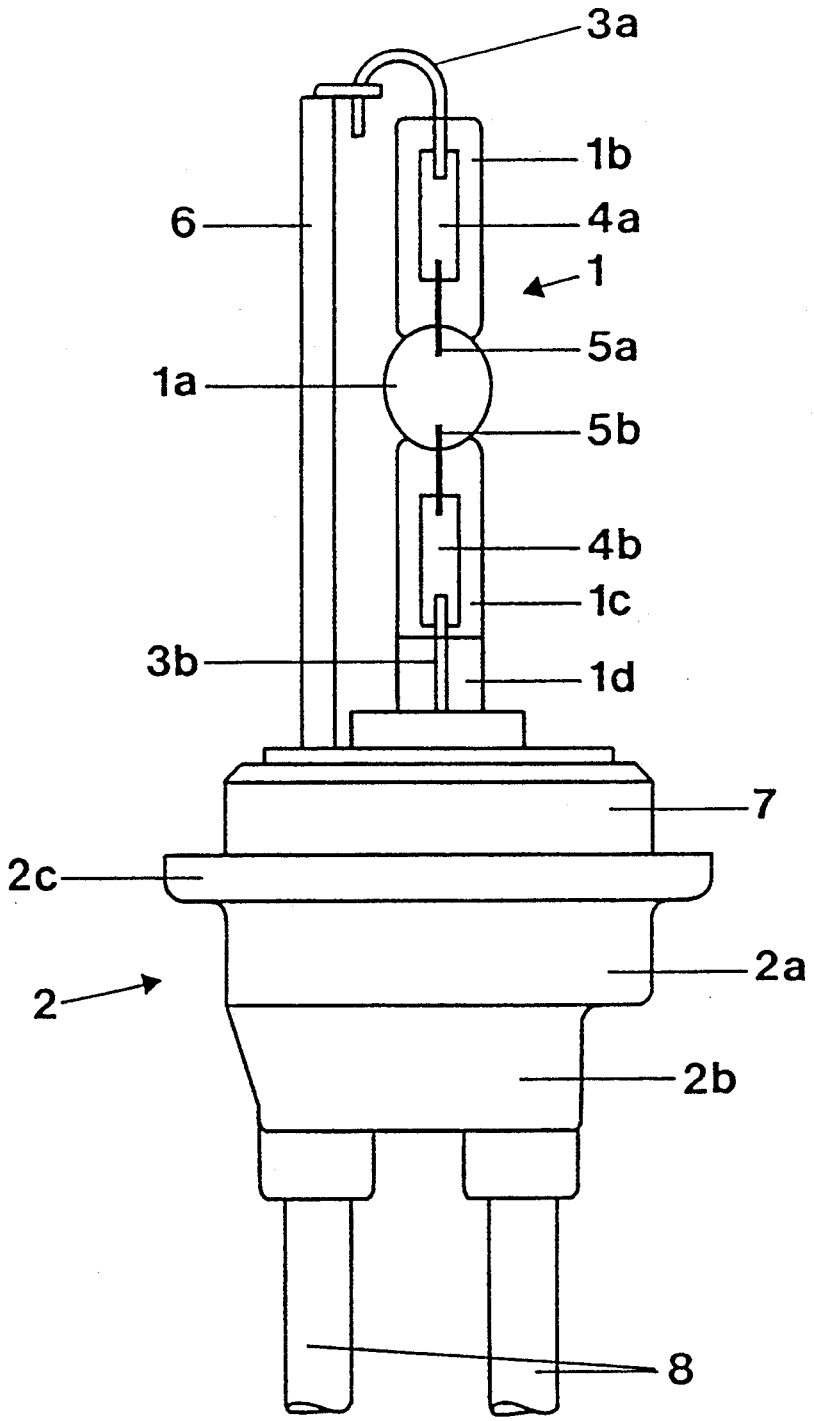
FIG. 1 is a highly schematic side view of a high-pressure discharge lamp-base combination.

The invention will be described with respect to a double-ended discharge vessel, best seen in FIG. 1. The vessel is made of quartz glass. The discharge lamp illustrated in FIG. 1 is a high-pressure metal-halide discharge lamp having a power rating of about 35 W, and especially suitable for use in vehicular headlights.

The discharge vessel 1 has a discharge space or discharge bulb 1*a* and two sealed ends 1*b*, 1*c*, located at opposite sides of the discharge bulb 1*a*. The end 1*c* is extended by a tubular extension 1*d*, likewise of quartz glass. The tubular extension retains the discharge vessel 1 in a holding portion 2*a* of the base 2. Current supply leads 3*a*, 3*b* extend from the ends 1*b*, 1*c* of the discharge vessel. The current supply leads are connected via molybdenum foils 4*a*, 4*b*, melt-sealed in the ends 1*b*, 1*c* to the discharge bulb 1*a*, for connection to electrodes 5*a*, 5*b* within the discharge bulb 1*a*. The current supply lead 3*a*, extending from the distal end of the discharge vessel 1, that is, the end remote from the base 2, is carried back towards the base 2; the major portion thereof is surrounded by a ceramic tube 6.

Figure 2:
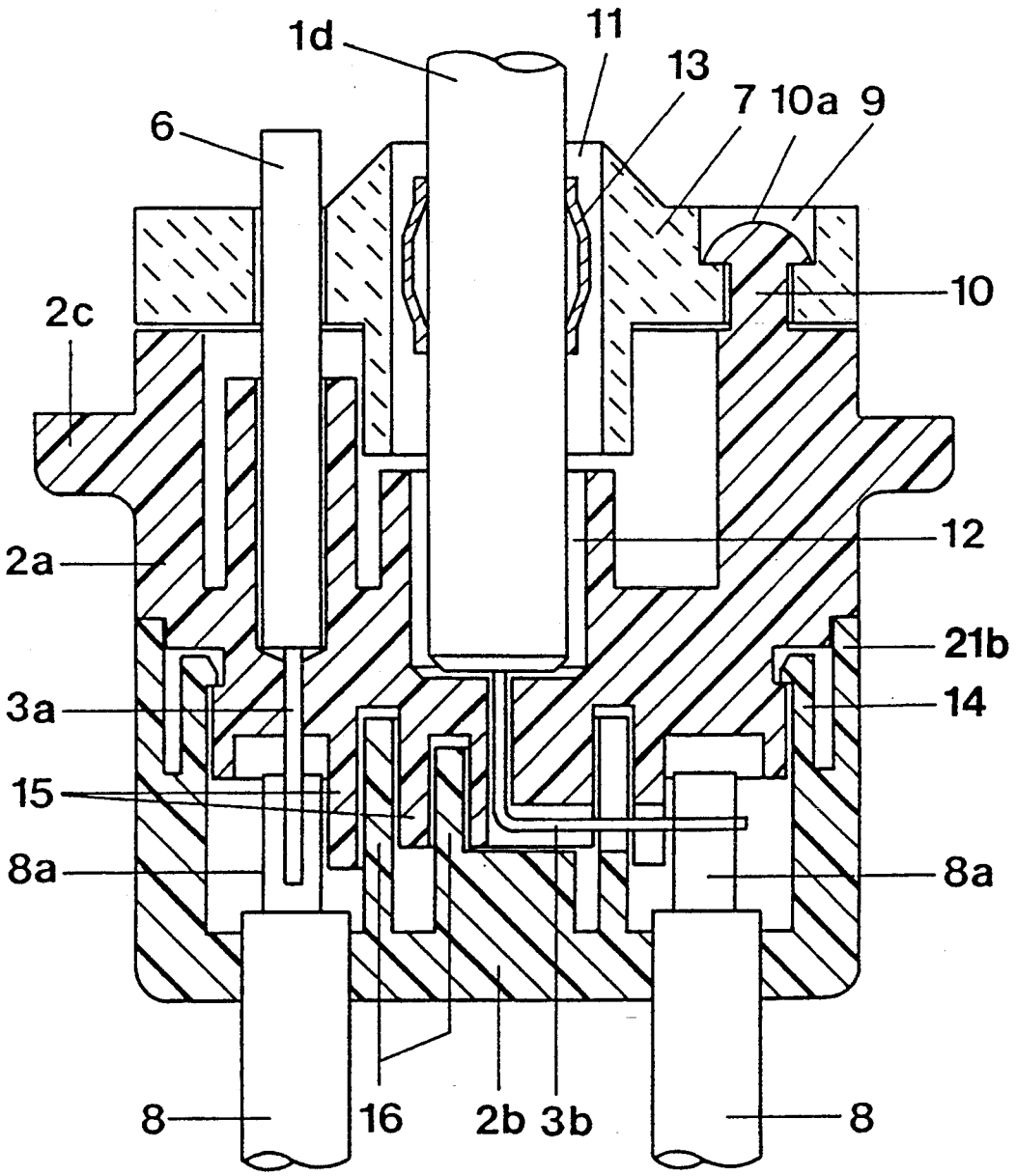
FIG. 2 is an enlarged cross-sectional view through the base and illustrating a first attachment arrangement for the lamp.

The base 2 has two portions, a holding portion 2*a* and a connecting portion 2*b*. The two portions are best seen in FIG. 2, and are both made of plastic material. The holding portion 2*a* has a circular flange 2*c*, formed with adjustment bumps or adjustment buttons to ensure a precise seat of the lamp within a reflector (not shown).

In accordance with a feature of the invention, the upper side of the holding portion 2*a* is covered by a cover 7 made of $Al_2O_3$ ceramic. This cover 7 protects the plastic material of the base 2 against UV radiation and, further, against high temperatures arising, in operation of the lamp, due to the arc discharge within the lamp.

The connecting portion 2*b* of the embodiment shown in FIG. 2 has two connecting cables 8 which are electrically connected to the current supply leads 3*a*, 3*b* extending from the discharge vessel 1. The connecting portion 2*b* and the holding portion 2*a* are snapped together.

Figure 3:
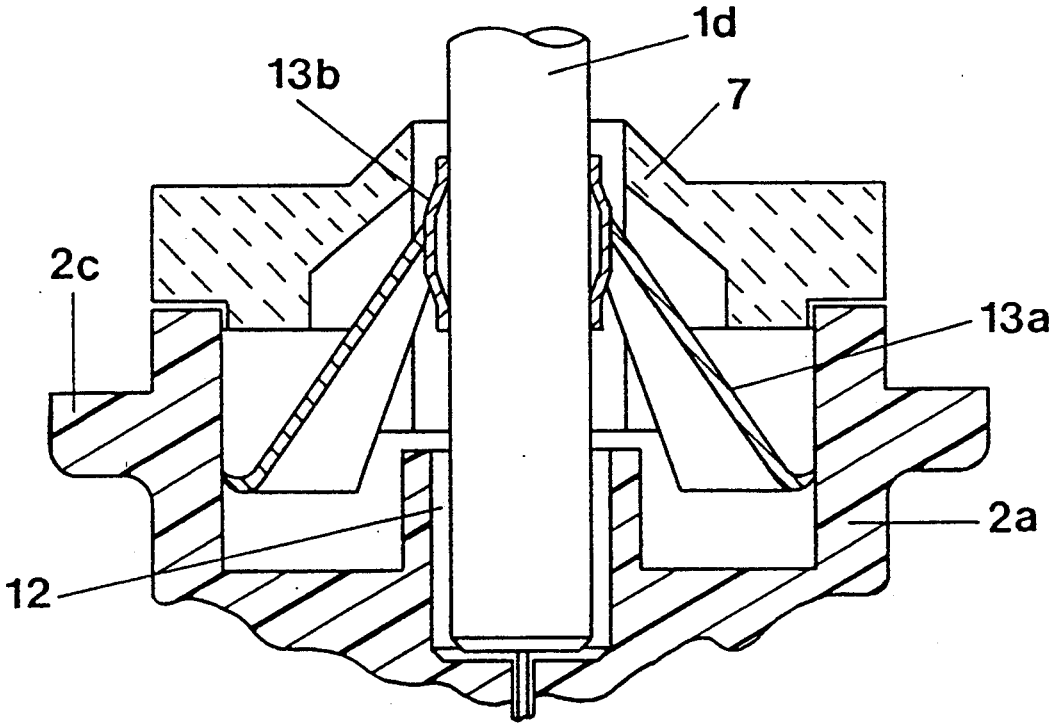
FIG. 3 is a fragmentary view of the holding arrangement for the discharge vessel, in which the section line is rotated 90° with respect to the section of FIG. 2.

Referring now both to FIGS. 2 and 3, for further details of the base 2:

In accordance with a feature of the invention, the ceramic cover 7 is irremovably connected to the holding portion 2*a* by ultrasound welding. For effective connection, the cover 7 has a number of openings 9 passing therethrough. Plastic pins 10, integral with the holding portion 2*a*, extend through the openings 9. The head of the pins or pin extensions 10, after placement of the cover 7, is then molten by ultrasound and spread out over a recessed shoulder in the opening 9, to form a button or rivet head. This ensures that the holding portion 2*a* and the ceramic cover 7 are irremovably connected after the molten pin heads 10*a* have been formed. The pin heads 10*a* are recessed in a countersink formed in the opening 9.

The ceramic cover 7, in accordance with a feature of the invention, is formed with a central opening 11 to receive the tubular extension 1*d* projecting from the discharge vessel 1. In addition, the cover 7, for example in form of a disk, is formed with a further opening for passage of the current supply lead 3*a* and the ceramic sleeve 6 therearound. The tubular extension 1*d* of the discharge vessel 1 is received in a reception recess 12 of the holding portion 2*a*.

The interior of the holding portion 2*a* is formed with a hollow space or chamber which is delimited by the bottom wall and side walls of the holding portion and by the cover 7. The reception recess 12 is centrally located within the inner chamber in the bottom of the holding portion 2*a*. It is so dimensioned that there is sufficient play for the tubular extension 1*d* to permit adjustment of the discharge vessel with respect to an optical system.

The discharge vessel 1 is secured in the base 2 by a metallic clip 13, see FIG. 3. The clip 13 surrounds the tubular extension 1*d* and has three extending legs 13*a* which are secured in the side walls of the holding portion 2*a*. Preferably, the legs 3*a* are resilient.

The clip 13 (FIG. 3) includes a collar 13*b* which surrounds the tubular extension 1*d* in the region of the opening 11 of the cover 7. It is clamped around the tubular extension 1*d*. The three legs 13*a*, which may be welded to the collar or may be unitary therewith, have end portions which are formed with extending claws or spikes or barbs or prongs. The leg portions 13*a* are biassed outwardly and, when seated in the base portion 2*a*, engage into the interior of the holding portion 2*a* and resiliently engage against the side walls of the holding portion 2*a*. After adjustment of the lamp, and holding the lamp adjusted within the holding portion of the base 2*a*, an electrical high-frequency pulse causes inductive heating of the metallic clamp or collar 13 and hence of the legs 13*a*. This causes heating of the walls of the holding portion 2*a* in the region of the engagement points or areas of the holding portion 2*a* with the legs 13*a*, and causes the claws or similar spikes or prongs extending from the ends of the legs 13*a* to penetrate into the softened region of the side walls. After the plastic material has hardened or set, the legs 13*a* are securely retained within the side walls of the holding portion 2*a*, and the lamp is maintained in adjustment with respect to the holding portion 2*a*.

The current supply leads 3*a*, 3*b* pass through the holding portion 2*a* through suitably formed openings, for connection to a respective end 8*a* (FIG. 2) of a connecting cable 8. The connecting portion 2*b* of the base 2 is irremovably connected to the holding portion 2*a* by a snap connection 14 formed by a resiliently deflectable extending leg from the connecting portion, snapping over a matching shoulder on the holding portion, and protected from access from the outside (and hence unauthorized release) by an outer side wall or shield portion 21*b*.

In accordance with a feature of the invention, the connecting portion and/or the holding portion are formed with separating ribs 15, 16, respectively, which are interdigited with respect to each other, and which separate the electrical connections 3*a*, 3*b* and the cable connections 8*a* of the respective cable parts. These interdigited separating ribs 15, 16 provide a labyrinthene path with respect to creep currents and spurious arc-over discharges or corona discharges between the current supply leads 3*a*, 3*b*. High-pressure discharge lamps, to be first fired, require a high voltage pulse in the kilovolt range, and thus high-voltage resistance between the connections to the lamp and the discharge vessel are important.

Figure 4:
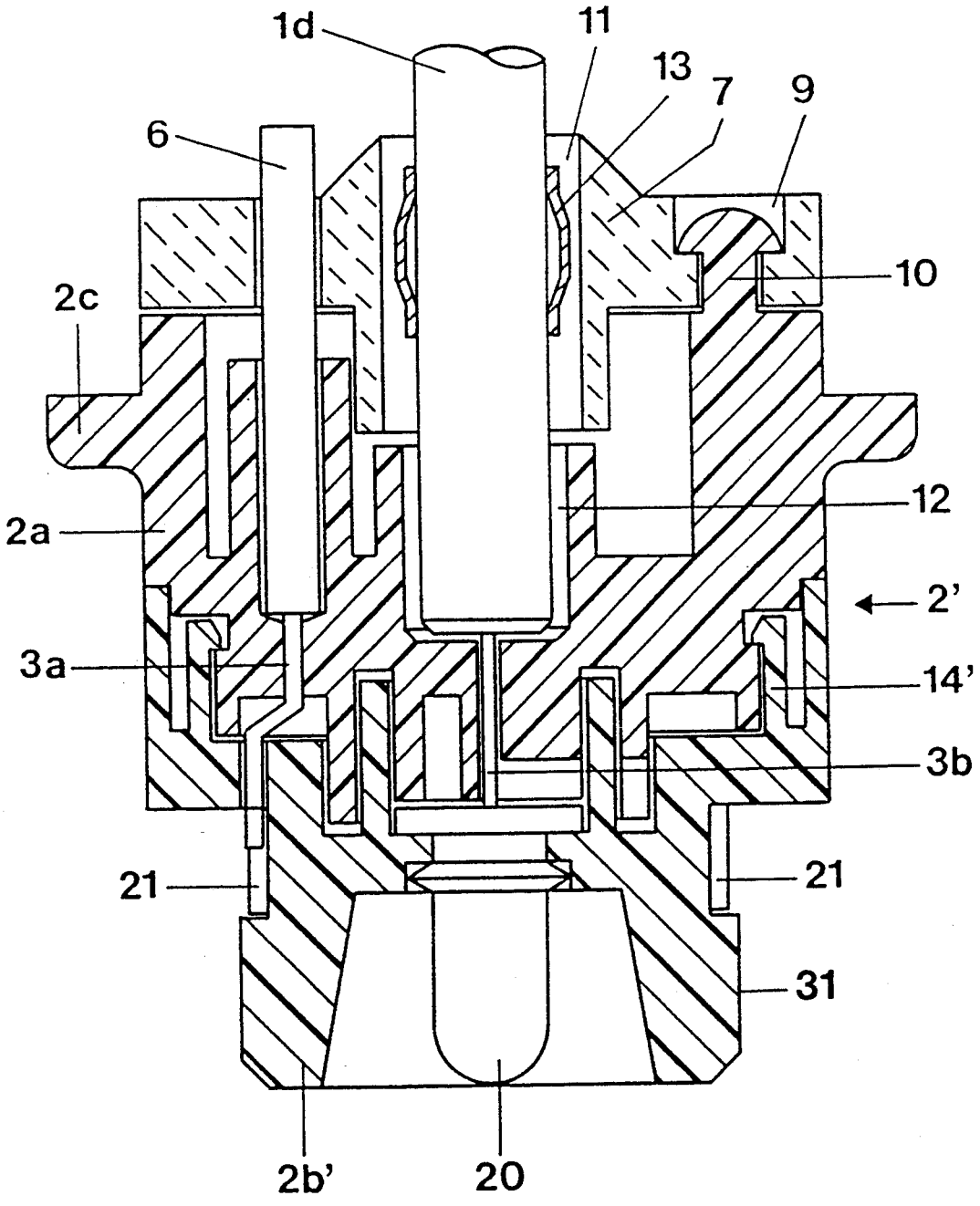
FIG. 4 is a cross-sectional view through another embodiment of a lamp base and illustrating a different connection portion from that of FIG. 2.

FIG. 4 illustrates another example of the high-pressure discharge lamp which differs from the example illustrated in FIGS. 1–3 only by the different construction of the connection portion 2*b*'. The base 2' of FIG. 4 has a connecting portion 2*b*' which, in contrast to the connecting portion 2*b* of FIG. 2, is formed as a plug connection. All other parts and identical elements have been given the same reference numerals and need not be described again.

The electrical connections of the connecting portion 2*b*', FIG. 4, includes a centrally located contact pin 20, or other suitable contacting elements such as a contact blade or the like. The contact element 20 is electrically connected with the current supply lead 3*b* which extends downwardly from the tubular extension 1*d*. The current supply lead 3*a* is electrically connected to a circular, at least part ring-shaped or segmental metallic collar 21. A non-releasable snap-in connection 14', similar to the snap-in connection previously described, connects the two parts together.

Figure 5:
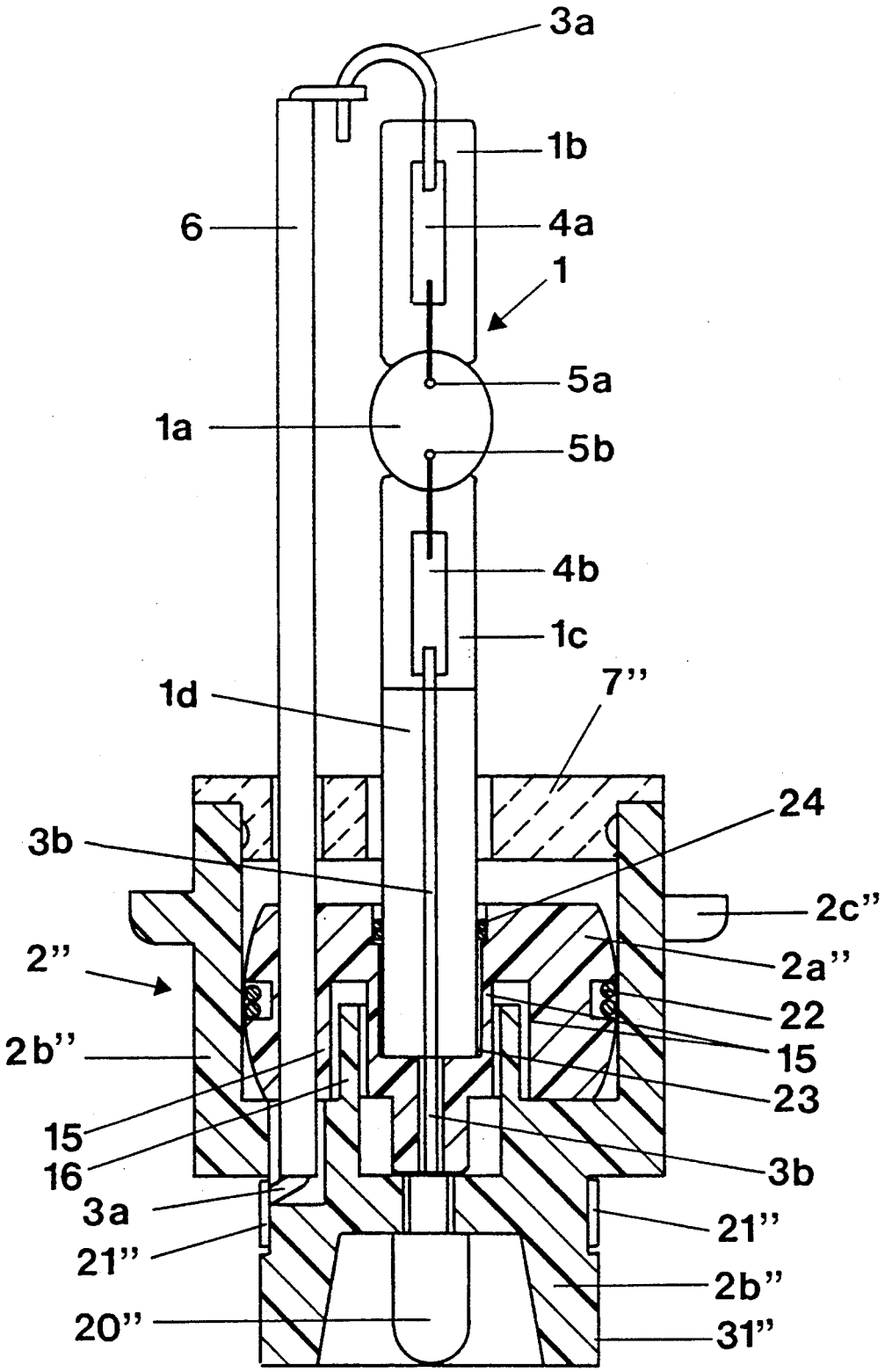
FIG. 5 is a part-sectional view of a double-ended lamp in a base, in which the holding portion of the base is melt-sealed to the lamp extension.

Embodiment of FIG. 5

FIG. 5 illustrates, partly in section, another embodiment of the high-pressure discharge lamp, and differs from the examples previously described essentially by the difference by which the discharge vessel 1 is held in the base 2''. As shown in FIG. 5, the holding portion 2*a*' and the tubular extension 1*d* of the discharge vessel 1 are differently retained in the base 2''. All other elements which are identical to those previously described have been given the same reference numerals and need not be explained again.

The base 2'' has a holding portion 2*a*'' and a connection portion 2*b*'', both of plastic material. The connecting portion 2*b*'' is of tubular shape and is formed with a ring flange 2*c*''. The ring flange 2*c*'' carries the adjustment buttons or bumps, to ensure a precise alignment of the discharge vessel 1 with respect to the base, and hence with respect to a reflector. The holding portion 2*a*'' is located in the interior of the cup-shaped connecting portion 2*b*''.

The holding portion 2*a*'' carries, at an outer circumference thereof, metal rings 22. After adjustment of the discharge vessel 1 with respect to the flange or flanged portions or portions 2*c*'', the holding portion is melted together with the side walls of the connecting portion 2*b*''. This is described in U.S. Pat. No. 4,795,939, Eckhardt et al, assigned to the assignee of the present application. The holding portion 2*a*' has an opening for the current supply lead 3*a* including the ceramic insulating sleeve thereover. Additionally, it has a reception opening 23 for the tubular extension 1*d* of the discharge vessel 1 and, further, a continuation of the opening, at a reduced diameter, for the proximate current supply lead 3*b*. The tubular extension 1*d* retains, in a slightly enlarged portion of the opening 23, an electrically inductively heatable metal insert 24 for secure retention of the tubular extension 1*d* in the reception opening 23 of the holding portion 2*a*''. This is also described in detail in the referenced application Ser. No. 07/694,465, filed May 1, 1991, Schoenherr et al, and assigned to the assignee of the present application.

The bottom, or terminal part of the connecting portion can be constructed as desired, and as required by the socket with which the lamp is to be used. As illustrated in FIG. 5, the bottom region of the connecting portion 2*b*'' is constructed as a plug-in element, with a centrally located contact pin 20'' and a conductive ring or collar or a segment 21'' surrounding the lower part or region of the connecting portion 2''. The central connecting lead 3*b* is electrically connected to the pin 20''. The connecting pin 20'' is surrounded by extending side walls 31''. The metallic ring 21'' is located within a ring-shaped recess formed in the outer surface of the side walls of the connecting portion 21'', and electrically connected to the distal current supply lead 3*a*. The contact pin 20'' and the metallic segment 21'' form the electrical connections of the connecting portion 2*b*''.

In accordance with the present invention, the upwardly open portion of the cup or pot-shaped connecting portion 2*b*'' is closed off by a cover 7'' of $Al_2O_3$ ceramic. The cover 7'' is formed with a central opening for the tubular extension 1*d* of the discharge vessel 1, and with a further opening to receive the distal current supply lead 3*a* and its ceramic insulation 6. The ceramic cover 7'' is irremovably connected to the connecting portion 2*b*'' by ultrasonic welding, for example by a button connection as described with reference to FIG. 2, button 10*a*.

Various changes and modifications may be made, and the invention is not limited to the examples above described. For example, the connecting arrangement 2*b*'' of FIG. 5 may be constructed to receive cables 8, as described in connection with FIG. 2, rather than the pin-and-ring connection as illustrated.

The connection between the holding portion 2*a*, 2*a*', 2*a*'' and the connecting portion 2*b*, 2*b*', 2*b*'' can be constructed in various, and differing ways, for example an interfitting push connection can be used or a screw connection. It is also possible to mold the two portions as a single unit. The interdigited labyrinthene connection to prevent creep paths can be constructed in somewhat simpler manner when extending the tubular ceramic element 6 close to the connection to the connecting ring 21, 21'' (FIGS. 4, 5) rather than as illustrated in connection with FIG. 2. FIG. 2 illustrates two ribs 16 extending upwardly from the connecting portion 2*a* and interdigited with depending ribs 15 extending from the holding portion; in FIG. 5, only one upstanding, essentially circular rib is surrounded by regions of the holding portion; the ceramic tube 6, however, extends through the holding portion into the connecting portion, close to the connection of the leads 3*a* with the ring 21''. Arrangements similar to those illustrated in FIG. 2 may, of course, also be used in connection with the arrangement of FIG. 5, in accordance with engineering requirements.

Various other changes and modifications may be made, and any features described herein in connection with any one of the embodiments may be used with any of others, within the scope of the inventive concept.

We claim:

1. A single-ended high-pressure discharge lamp having a discharge vessel (1) having a projecting, elongated end portion (1*d*);

two current supply leads (3*a*, 3*b*) extending from said discharge vessel;

a base (2, 2', 2'') of plastic material;

a cover element (7, 7″) of high temperature resistant and UV radiation resistant, and essentially UV opaque material, positioned to shield the plastic base (2) from UV radiation and from heat radiation emitted from the discharge vessel when the lamp is in use;

wherein the lamp base (2, 2′) has a lamp holding portion (2*a*, 2*a*″) and a connecting portion (2*b*, 2*b*′, 2*b*″), which is coupled to the holding portion (2*a*, 2*a*);

wherein electrical terminal connections (8*a*; 20, 21, 20″, 21″) are provided, secured to the connecting portion; and wherein the connecting portion (2*b*, 2*b*′, 2*b*″) and the holding portion (2*a*, 2*a*″) are formed with interdigited separating ribs (15, 16) and interdigited with respect to each other, and separating the current supply leads (3*a*, 3*b*) and the respective electrical terminals (8*a*) to form a labyrinthene path for creep currents and prevent arc-over upon application of high-voltage pulses to oppositely energized ones of said current supply leads upon starting of the discharge lamp.

2. The lamp of claim 1, wherein said cover element (7, 7″) comprises ceramic and optionally aluminum oxide ($Al_2O_3$) ceramic.

3. The lamp of claim 1, wherein said cover element (7″) is a single, essentially disk or plate-like element, and formed with a central opening (11) for the elongated end portion (1*d*) of the discharge vessel, and, optionally, with a further opening for a separate current supply lead (3*a*).

4. The lamp of claim 1, wherein said cover element (7″) is irremovably connected to the holding portion (2*a*) of the base.

5. The lamp of claim 1, wherein said holding portion (2*a*) is formed with an inner chamber delimited by a bottom and side walls of the holding portion (2*a*) as well as by the cover element (7);

a reception recess (12) is formed in the bottom of the holding portion (2*a*) dimensioned to receive the elongated end portion (1*d*) of the discharge vessel, with play or clearance.

6. The lamp of claim 1, further including a metal clamp (13) surrounding the elongated end portion (1*d*) of the discharge vessel, said metal clamp being anchored within the holding portion (2*a*) of the base (2).

7. The lamp of claim 6, wherein the metal clamp (13) comprises a collar or ring portion (13*b*) clampingly surrounding the elongated end portion (1*d*) of the discharge vessel; and resilient leg portions (13*a*) connected to the collar or ring portion (13*b*), said leg portions being securely anchored within the holding portion (2*a*) of the base.

8. The lamp of claim 1, wherein the connecting portion (2*b*, 2*b*′) and the holding portion (2*a*) are connected by a projection-and-recess snap connection (14).

9. The lamp of claim 1, wherein (FIG. 5) the base includes a connecting portion (2*b*″) configured in cup or pot shape with a central opening;

the holding portion (2*a*″) is located in said central opening; and electrical terminal connections (20″, 21″) are located on the connecting portion (2*b*″).

10. The lamp of claim 9, wherein the cover element (7″) is irremovably connected to the connecting portion (2*b*″), and closes off the central opening of the cup or pot-shaped connecting portion.

11. The lamp of claim 1, wherein the electrical terminal connections comprise two connecting cables (8) extending from the connecting portion (2*b*) and electrically connected to a respective current supply lead (3*a*, 3*b*).

12. The lamp of claim 1, wherein the connecting portion (2*b*′, 2*b*″) is formed as a plug connector having a first terminal pin or blade (20, 20″) and a connecting ring or ring segment (21, 21″), the terminal pin or blade and the connecting ring or ring segment being, respectively, electrically conductively connected to a respective current supply lead (3*a*, 3*b*).

13. The lamp of claim 1, wherein the connecting portion comprises a plug connection having at least one extending terminal pin, post or blade, electrically connected to a respective current supply lead (3*a*, 3*b*).

14. The lamp of claim 1, wherein said cover element (7, 7″) is essentially in disk or plate form seated on the base (2).

15. The lamp of claim 1, wherein said cover element (7, 7″) is formed with attachment openings; and said base (2) is formed with pin extensions (10) extending through said attachment openings, and formed with a rivet or button head in a recessed section of said opening for irremovably retaining the cover element on the base.

16. The lamp of claim 1, wherein said discharge vessel is a double-ended discharge vessel and one (3*a*) of said current supply leads extends parallel to said discharge vessel and into said base (2).

* * * * *